United States Patent [19]

Zöllner et al.

[11] Patent Number: 4,462,104

[45] Date of Patent: Jul. 24, 1984

[54] ELECTRODE HOLDER FOR ELECTRIC ARC FURNACES

[75] Inventors: Dieter Zöllner, Schwaig; Inge Lauterbach-Dammler, Nuremberg; Friedrich Rittman, Rückersdorf; Franz Schieber, Röthenbach, all of Fed. Rep. of Germany

[73] Assignee: Arc Technologies Systems, Ltd., Cayman Islands

[21] Appl. No.: 438,582

[22] Filed: Nov. 2, 1982

[30] Foreign Application Priority Data

Nov. 9, 1981 [DE] Fed. Rep. of Germany ..... 3144437
Nov. 9, 1981 [DE] Fed. Rep. of Germany ..... 3144520

[51] Int. Cl.[3] ..... H05B 7/08
[52] U.S. Cl. ..... 373/93
[58] Field of Search ..... 373/93, 90, 88

[56] References Cited

U.S. PATENT DOCUMENTS

| | | | |
|---|---|---|---|
| 3,385,987 | 5/1968 | Wolf et al. | 373/93 X |
| 3,392,227 | 7/1968 | Ostberg . | |
| 4,145,564 | 3/1979 | Andrew et al. | 373/93 |
| 4,189,617 | 2/1980 | Schwabe et al. . | |
| 4,256,918 | 3/1981 | Schwabe et al. | 373/93 |
| 4,287,381 | 9/1981 | Montgomery | 373/93 X |
| 4,291,190 | 9/1981 | Elsner et al. . | |

*Primary Examiner*—Roy N. Envall, Jr.
*Attorney, Agent, or Firm*—Woodrow W. Ban

[57] ABSTRACT

An electrode holder for arc furnace electrodes having a cooled metal shaft at least partially surrounded by a protective jacket of hollow cylinder configuration, generally moldings resistant to elevated temperatures. The protective jacket can surround and protect portions of the electrode holder positioned within the furnace or portions of the electrode holder in a zone engaged by clamping jaws. The protective jacket consists of individual moldings configured to provide generally ring shapes which may be put together to form rings, and coherently surrounding the metal shaft.

30 Claims, 23 Drawing Figures

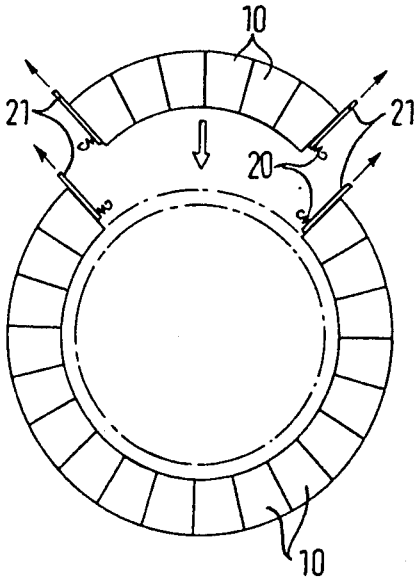
FIG. 5
FIG. 2
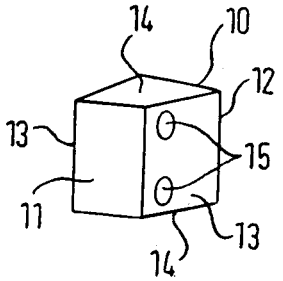
FIG. 3
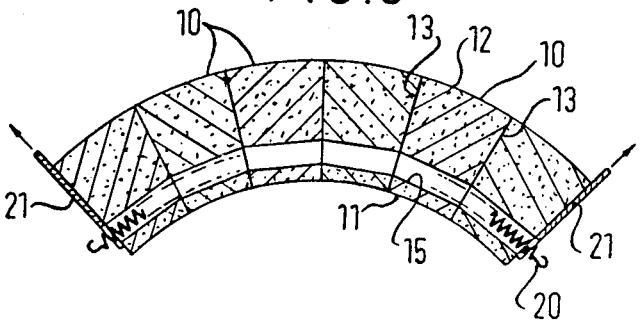
FIG. 4
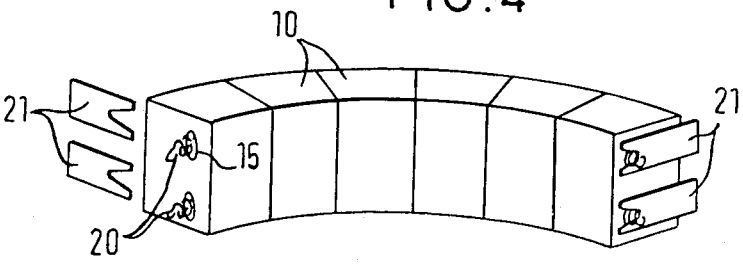

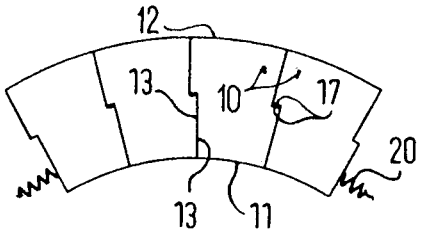
FIG. 7
FIG. 6
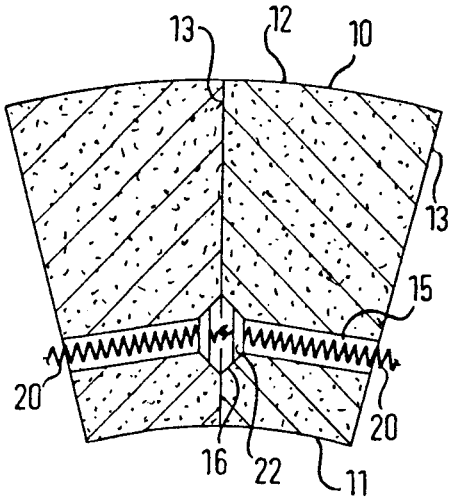
FIG. 8
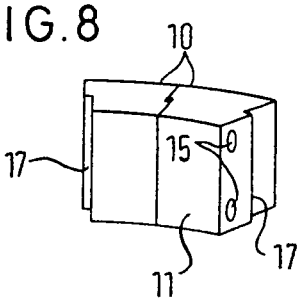
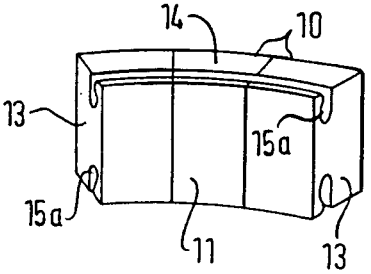
FIG. 10
FIG. 9
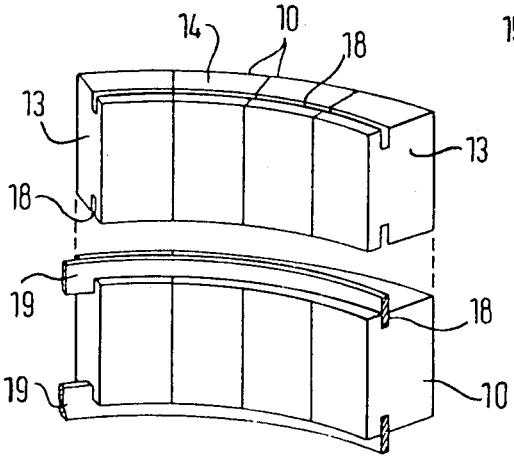

ELECTRODE HOLDER FOR ELECTRIC ARC FURNACES

FIELD OF THE INVENTION

The invention relates to electrode holders for electric arc furnaces having a water-cooled metal shaft and a working part of consumable material, with the metal shaft being, at least partly, surrounded by moldings of a material resistant to elevated temperature.

BACKGROUND OF THE INVENTION

Electrodes employing such electrode holders are available in two basic configurations. According to the one configuration, the electrode consists of two axially aligned sections, i.e. the electrode holder, constituting the upper section and comprising a cooled metal shaft, and at its lower tip, an active part of consumable material from which the electric arc eminates. This type of electrode is generally known as combination electrode. With a second configuration, the active part of consumable material is axially movable within the electrode holder, generally a cooled metal shaft. As consumable material of the active part is consumed at the electrode tip, compensation can be effected by axial movement of the active part. Such electrodes are generally known as conventional feed-through electrodes. A common criterion of both configurations is that the electrode holder, i.e. the liquid-cooled metal shaft, during operation, projects at least partly into the interior of the furnace.

Electrodes for electric arc furnaces are exposed to powerful thermal and mechanical stress. Thermal stress conditions result from the elevated electrode working temperatures characteristic of the production of electric steel. Mechanical stress is caused for example when the electrode contacts scrap material, or may result from movements of molten metal or scrap material within the furnace, or from vibrations related to the electric arc.

In order to ensure the usefulness of these electrodes it is, therefore, imperative to protect effectively the metal shaft of the electrode holder, which during operation is confined within the interior of the furnace, against these stresses. Numerous solutions have been offered to this problem.

One combination electrode holder described in BE-PS No. 867 876 takes the form of a metal shaft containing the cooling system and surrounded by a coating resistant to elevated temperature on the outside. In order to improve the adhesive capacity of this coating on the sheath area, the metal shaft has hooks configured for holding the coating in place.

Similar combination electrodes and holders are described in GB-PS No. 1 223 162, completely covered with a protective ceramic coating. With these ceramic coatings, attention to the thickness of the ceramic coating is necessary, which should be as small as possible, and to the extent to which such a coating is applied including the electrode holder proper thereby ensuring the insulation of coolant pipes therein. These pipes serve not only as cooling water ducts but also as current supply to the active graphite electrode part.

European patent application No. 0 010 305 describes a combination electrode with an electrode holder comprising a metal shaft electrically insulated from a current-carrying cooling system and which can be sufficiently cooled through material resistant to elevated temperature interposed between the cooling system and the metal shaft. The lower section of the metal shaft, which constitutes the electrode holder, is covered with a ceramic coat that is also secured by hooks.

The combination electrode of DE-AS No. 27 25 537 has a metallic, liquid-cooled upper section constituting the electrode holder, which is insulated by a material resistant to high temperature covering thermally conductive projections. The purpose of these projections is to prevent a direct mechanical contact with the line system if, as a result of high local stress, the high-temperature resistant material is locally damaged by scrap material. At the same time these projections perform as a kind of fuse, thereby preventing excessive currents from passing.

Finally, DE-AS No. 27 30 884 describes a conventional feed-through electrode having a cooled metal shaft, constituting the electrode holder and serving as a passage through which the active part of graphite is fed, covered with high-temperature resistant material. At the same time the metal shaft has projections directed radially towards the outside which fastenly engage a material resistant to high temperature. These projections, which are distributed along the periphery and in an axial direction as evenly as possible, appear configured to ensure a more constant cooling and better adhesion of the material resistant to high temperature to the shaft. This solution corresponds to the protective coat designs mentioned in connection with combination electrodes. According to the most recent state of technology, the same solutions are offered for the electrode holders of combination electrodes and conventional electrodes.

All these electrode holders have one common disadvantage in that the protective jacket, even if it is only slightly damaged locally, has to be removed from the metal shaft of the electrode holder and a new protective jacket has to be applied which can cause lengthy production interruptions and high costs.

A further disadvantage of conventional electrode holders is the formation of slag and metal layers on the protective jacket of ceramic material, which can lead to disorders in arc furnace operation.

It was, therefore, suggested to create an electrode holder having a cooled metal shaft protected by rings of a material containing carbon, preferably graphite. Electrode holders of this general type have been employed and the protective carbon jacket mentioned has proved extremely useful. Graphite rings act as an excellent protective coat from the mechanical as well as the thermal viewpoint. One advantage of such a protective jacket is that, if it is partly damaged, the graphite ring in question may be exchanged, while complete removal of the jacket is only required if continuous protective coatings are used. A further advantage is that the formation of slag or metal layers is avoided, for due to the destruction of the graphite surface by oxidation they keep falling off the protective jacket. One disadvantage is, however, that in some cases the rings show a certain tendency towards cracking, believed caused by differing coefficients of thermal expansion of the protective jacket and the metal shaft constituting the electrode holder, and, consequently, by the resulting tensions within the protective ring.

Furthermore, there is one problem that all electrode holders described have in common, namely, how the metal parts can be fastened above the furnace lid. In general, this is achieved by means of mechanical clamping devices. Considering such factors as easy handling or quality of electric contact, it is advantageous to use such a mechanical clamp also as a means of current transfer. As a consequence, graphite or carbon moldings are usually used between the metallic part of the electrode and the clamping jaws of a bearer arm, for these moldings combine favourable current transfer properties with good mechanical and thermal properties.

However, the way how these moldings are to be fastened to the electrodes poses problems, as the moldings may break due to the clamping forces required. This may, in turn, lead to the loss of the moldings when, in varying the place of clamping e.g., the clamps have to be removed.

DESCRIPTION OF THE INVENTION

The object of the present invention is to create a protective jacket for the cooled metal shaft of electrode holders of the type mentioned which fully meets all thermal, mechanical, and electrical requirements, which has a design as simple as possible, which can be easily mounted and repaired, and which guarantees a good heat transfer to the cooled metal shaft of the electrode holder in order to improve the service life of the protective jacket.

With regard to the type of electrode holder in question, this problem is solved by the connection of moldings or sectors to the metal shaft and/or among each other in a removable manner by means of form locking and/or resilient connection elements.

The solution in accordance with the invention provides a protective jacket that meets all electrical, thermal, and mechanical requirements. If a resilient connection is employed, prestresses associated with individual moldings of the protective jacket make such moldings rest snugly on the metal shaft of the electrode holder, resulting in a good heat transfer between the protective jacket and metal shaft generally over the entire shaft area. This good heat transfer is achieved without inserting any filling material between the protective jacket and the metal shaft of the electrode holder. In addition, in part due to the resilient connections, the individual moldings tend to balance tensions caused by the differing thermal expansions of the material of the protective jacket on the one hand and the material of the metal shaft of the electrode holder on the other. Thus, there is a substantially lessened danger of the protective jacket being damaged by this thermal expansion. The protective jacket is, therefore, in a position to meet all thermal requirements.

With respect to mechanical stress, by connecting the sectors in accordance with the invention, i.e. among each other or to the metal part, it is possible to balance the production tolerances of the moldings so that their combined inner surface is always snugly pressed against the outer surface of the metal shaft of the electrode holder. In this way, compressive and bending forces are transferred from the protective jacket to the metal shaft of the electrode holder without any excessive strain on the material of the protective jacket as a result of insufficient contact between protective jacket and metal shaft. At the same time, the metal shaft of the electrode holder is also protected by the moldings. Finally, depending on the requirements, the moldings are easy to mount or dismount. For this purpose, individual moldings or groups of moldings are preferably axially moveable along the metal part. It is e.g. possible to connect several moldings or sectors which then form a partial ring, or to connect two or more partial rings which then form one complete ring. This means that a protective ring may be directly mounted on the metal shaft of the electrode holder. If one or several sectors or moldings of the protective ring are damaged, the damaged sector may simply be exchanged. If the protective jacket consists of several rings each of which is made up of sectors, the ring at the lower tip of the metal shaft of the electrode holder which is, of course, exposed to the highest strain within the furnace and, therefore, more likely to be damaged or worn than the rings arranged further to the top, should be removed first. It should be replaced by either a new ring or a ring used in the upper section of the metal shaft that is still suitable for the lower section. In this way it is possible to replace the rings successively, to reduce assembly time, and to cut the maintenance costs for the protective jacket of the electrode holder.

Advantageous alternate preferred embodiments of the electrode holder in accordance with the invention result as well.

According to preferred embodiments, the sectors may consist of non-graphitic or partly graphitic materials containing carbon, providing economical service lives for the protective rings, while providing properties of the carbon material with regard to slag or metal splashes that are also favourable. If the dimensions of the protective rings are correct, a desired slow oxidation of carbon will be achieved especially on hotter exterior peripheral areas of the rings, which discourages the accumulation of slag or metal parts, a disadvantage frequently observed when ceramic coatings are used.

Since the solution in accordance with the invention offers an excellent heat transfer from the protective jacket to the metal shaft of the electrode holder, it is recommended that the protective jacket be made of materials that have a low thermal conductivity. Among the materials containing carbon, the so-called non-graphitic or partly graphitic materials are, therefore, especially suitable.

Where the advantage of self-purification of the exterior surface of the protective rings can be dispensed with, ceramic materials may also be used for making rings. Often it is useful to use ceramic materials for the sectors adjacent upper portions of the metal shaft of the electrode holder, and materials containing carbon for the sectors in the lower portion. Other solutions, such as a mixed arrangement of rings or sectors of different materials, are also possible.

It is certainly an advantage that the resilient non-positive connection of the sectors among each other and the formation of prestress, enabling a ring consisting of sectors to snugly rest on the metal shaft of the electrode holder, are achieved by spring power.

As far as the arrangement of the springs producing the spring power is concerned, there are a number of possibilities. Each protective ring may have one or several spring rings, with each spring ring being formed either by one spring or by several springs connected in series.

The springs are located in sector bores or recesses which are concentric to the ring. In this way the springs are incorporated in the sectors, which is a great advantage, the spring being protected against excessive thermal and mechanical stress.

In order to further reduce the thermal strain on the springs, the bores or recesses are located near the inner sheath area of the sectors, which means that the springs and the cooling system of the metal shaft are as near as possible to each other so that the temperature in the spring zone is kept desirably low.

Any suitable or conventional spring may be used such as spiral springs or leaf springs.

It is of special importance that the springs consist of a non-magnetic material in order to avoid the heating of the springs as a result of hysteresis losses.

Basically, the springs should be characterized by a high heat resistance. For this reason the springs preferably are made of austenitic chrome-nickel-molybdenum steels or of material containing beryllium.

In accordance with a further preferred embodiment of the invention, abutting surfaces of neighbouring sectors, lying either in peripheral and/or axial direction, have at least one complementary radial graduation. Even if the abutting surfaces of neighbouring sectors do not snugly fit due to tolerances, these interlocking graduations tend to assure that the sectors are well sealed, which, in turn, results in a safe protection of the cooled metal shaft of the electrode holder.

According to another embodiment, the width of the sectors measured in peripheral direction is relatively small, with the abutting surfaces and the radial beam of the hollow cylinder forming an angle. This means that in relation to the respective radii the relatively thin sectors of a ring rest in an oblique manner on the metal shaft. Thus tolerances are balanced as a result of the so-called "effect of self-adjustment", with the sectors or moldings adjusting themselves in a more vertical or a more horizontal position depending on the diameter of the metal shaft and/or the inside diameter of the sector ring.

This "self-adjustment" effect results from the fact that the inclined sectors of the protective ring are arranged by and in accordance with the tangential force component of the spring tension. The tangential force component of the spring tension is achieved if, in the individual sectors (which are aligned along the periphery) the one end of the bore or recess for the spring has a greater distance from the sheath area of the metal shaft than the other end of the bore or recess in question.

This sector adjustment can be observed particularly if the inner sheath areas of the sectors are smaller than the outer sheath areas resulting theoretically from the circular division. The result is a protective ring which, if properly mounted, has splits between the sectors. These splits become wider towards the inside. The sectors are arranged in such a way that wedge-like splits are formed between the sectors. As mentioned before, these splits always open up towards the inside and are closed on the outside, even if the diameter decreases.

For the adjustment process described above it is useful that the sectors have a planar inner sheath area so that they can move and align themselves accordingly on the sheath area of the metal shaft. The outer sheath areas of the sectors may also be planar and need not have a cylindrical shape. In addition, the inner as well as the outer sheath area of the sectors may have suitable profiles.

In order to avoid the heating of springs, particularly, of springs closed in peripheral direction, particularly resulting from potential parasitic currents, it may be useful to build at least one electrically insulating connection element into the spring. Such a connection element may e.g. consist of highly sintered aluminum oxide.

For similar considerations of electrically insulating elements may be incorporated between the abutting surfaces of the sectors. Particularly these insulating elements apply in use to abutting surfaces in peripheral directions. Abutting surfaces in axial direction may also be kept at a distance by means of electrically insulating elements, however.

Where form locking connections are employed between sectors, it may be advantageous to design the connection elements as sliding connections the sliding direction of which is parallel to the axis of the metal shaft of the electrode holder. In this way it is possible to move either the moldings or individual sectors thereof either upwardly or downwardly in a simple way so that partly damaged rings or sectors can be exchanged without causing extensive assembly work or the use of an excessive number of spare or replacement rings or sectors.

In a concrete example the positive sliding connection mentioned is configured as a dovetail guide. This dovetail guide is not only mechanically solid but also enables the user to slide the sectors in a simple manner supported by the sheath area of the metal shaft of the electrode holder.

Dovetail guide grooving is generally located n the inner surfaces of the moldings or sectors, while the contact strips for engaging the dovetail guides are mounted on the surface of the metal shaft. This location of grooves on the inner sheath area of the sectors is advantageous because the loss of the relatively expensive sector material, which is extremely resistant to thermal and mechanical stress, is kept to a minimum.

For reasons of expediency, the contact strips are separate components which are fastened to the surface of the metal shaft by riveting, bolting, welding or a similar method, helpful not only in saving sheath material for the metal shaft of the electrode holder but also in mounting the contact strips on relatively thin-walled metal shafts. The cooled metal shaft of the electrode holder usually consists of copper, which is very expensive so that material savings are really decisive. Moreover, the metal shaft or the pipes making up the metal shaft which are intended for the cooling agent and the current supply, have to have relatively thin walls in order to obtain a cooling efficiency that is optimal for the entire unit.

If the protective jacket consists of several rings that are made up of sectors, it may be practical to place a unitary or one-piece ring between any two rings consisting of sectors. As a result, the carrying capacity of the protective jacket may be further enhanced.

In accordance with an alternate preferred embodiment of the invention, the contact strips are interrupted in axial direction of the metal shaft, with the distance between two aligned contact strip sections being not greater than the twofold axial height of a sector in this region. In this way it is possible to remove damaged or worn sectors and replace them by new ones even in the middle zone of the protective jacket without having to remove the sectors above or below. This also helps to reduce assembly time.

Furthermore, it is advantageous if the contact strip sections are grouped in rings and if the contact strips of one group and the contact strips of the axially neighbouring group are staggered in peripheral direction. This results in a sector arrangement that is staggered ring by ring, which leads to a further increase in the mechanical stability of the protective jacket.

If that embodiment of the invention is used where at least one unitary or one-piece ring is part of the protective jacket, it is recommended that, at the place where the unitary ring is to be mounted, the axial distance between two neighbouring groups of contact strips be somewhat greater than the axial height of the unitary ring. The unitary ring may then be rotated about the electrode holder so that its grooves and the contact strips of the neighbouring groups are offset, which results in the ring being arrested in axial direction. Thus the ring serves as a support for all sectors or rings consisting of sectors that are located above the ring. If, therefore, the sectors below the ring break and become disengaged in part or whole, sectors above the ring are prevented from slipping along. Therefore a large part of the metal shaft of the electrode holder remains protected by undamaged sectors, even if the protective jacket is damaged considerably. In this way it is possible to reduce damage to the electrode holder.

Sectors and/or one-piece rings should consist of non-graphitic or partly graphitic materials containing carbon. As a consequence, the life time of protective rings will be satisfactory from the economic point of view. A further advantage of the carbon-containing material relates to its favourable properties as far as slag or metal splashes are concerned. In protective rings having proper dimensions, the oxidation of carbon proceeds as slowly as desired, especially on the hotter peripheral areas of the rings, thus reducing or preventing the troublesome accumulation of slag on metal parts frequently observed with respect to electrode holders having ceramic coatings.

The solution in accordance with the invention provides an excellent heat transfer from the protective jacket to the metal shaft. It is, therefore, recommended that materials of low thermal conductivity be used for the protective jacket. Among such materials, those containing carbon, and the so-called non-graphitic or partly graphitic materials are especially suitable for this purpose.

If the user intends to do without the advantage of self-purification of the protective ring surface, that is without the advantage of the oxidation of carbon providing for freeing of the surface of the protective coating of slag, ceramic materials may also be employed for making rings and sectors thereof.

Depending upon the performance requirements, the materials used in making the protective jacket may vary, i.e. materials containing carbon as well as ceramic materials may be used for making both sectors and one-piece rings. Preferably, ceramic materials are used for making sectors for use upon upper portions of the metal shaft, and materials containing carbon for sectors for lower portions. Mixtures of rings or sectors formed of different materials are also contemplated.

While connecting the moldings located between metal shaft and clamping jaws in accordance with the invention, it is preferable to use a form locking connection supported by resilient clamping. Particularly, axially directed pairs of rails are affixed to the metal shaft shaped to keep axially directed rims or edges of the moldings between rail parts projecting from the metal shaft and the metal shaft proper. Such rails are generally therefore characterized by a section adjacent to the metal shaft, a section leading away from it, and a section that is parallel to the metal shaft.

BRIEF DESCRIPTION OF THE DRAWINGS

Some embodiments of the electrode holder are illustrated in the accompanying figures in which

FIG. 2 is an illustration of a hollow cylinder sector, which with other similar sectors make up the protective jacket of the electrode holder in accordance with the invention.

FIG. 3 is a sectional view of a partial ring consisting of several sectors.

FIG. 4 is a projection of the partial ring of FIG. 3.

FIG. 5 is an illustration of the assembly of the protective jacket of the electrode holder in accordance with the invention, with the ring being made up of sectors that consist of several partial rings.

FIG. 6 is an illustration of one preferred connection for springs forming ring sectors to form a ring or a partial ring.

FIG. 7 is an illustration of another preferred embodiment of the sectors.

FIG. 8 is a perspective view of the sectors of FIG. 7.

FIGS. 9 to 11 are illustrations of two possible axial means for joining rings consisting of sectors.

DETAILED DESCRIPTION OF THE DRAWINGS

Figure 1:
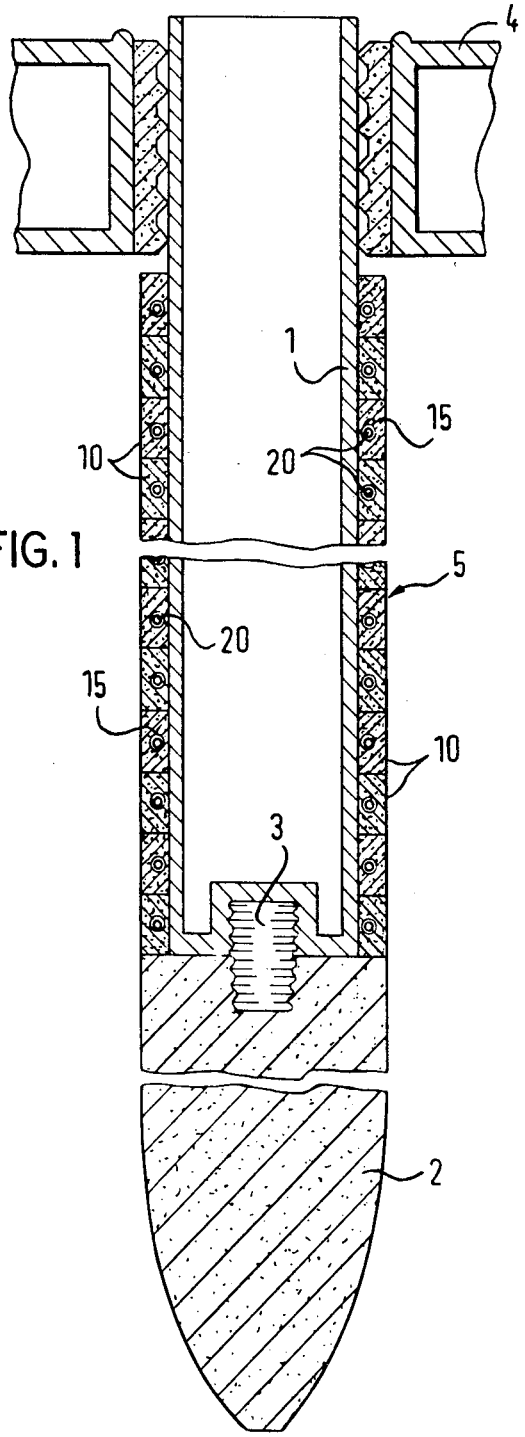
FIG. 1 is a schematic full-view illustration of an electrode with an electrode holder in accordance with the invention.

FIG. 1 is a schematic illustration of the basic structure of a combination electrode for electric arc furnaces. This electrode comprises an electrode holder that is formed by a cooled metal shaft 1. An active part 2 of consumable material, e.g. graphite, is attached by means of a threaded nipple 3 to the lower tip of the metal shaft 1 constituting the electrode holder. The electrode is held by a supporting structure 4 affixed to the upper section of the metal shaft 1 of the electrode holder. FIG. 1 is a schematic illustration only, the electrical components and cooling elements are not shown, as they may be of the conventional type. The only part that is important in connection with the invention is the hollow cylindrical protective jacket 5 of temperature-resistant material which surrounds that section of the metal shaft 1 which remains within the furnace, thus protecting it from excessive thermal and mechanical stress.

The protective jacket 5 is made up of hollowed cylinder sectors 10 as shown in FIG. 2. The hollowed cylinder sector has an inner 11 and an outer sheath area 12, two abutting surfaces in peripheral direction 13, and two faces in axial direction 14. In addition, the sector has two bores 15 which are located on one chord.

FIGS. 3 and 4 clearly show how several sectors 10 form a partial ring by joining their abutting surfaces 13. The sectors 10 of this partial ring are connected by springs which pass through the bores 15. In FIG. 3 the springs shown are spiral springs 20. Fork-like clamping elements 21 guarantee that the spiral springs 20 are secured at the end, thus prestressing them. These elements 21 hook on counter stops located at the end of the springs 20 or on their windings, thus keeping the springs 20 in a prestressed position.

FIG. 4 illustrates on the left how the clamping elements 21 are fastened, while on the right of the illustration they are already arrested.

FIG. 5 shows how partial rings, which consist of sectors 10, are joined, thus forming a complete ring. The partial rings are successively joined by connecting the respective tips of the springs 20 which are kept in a prestressed position by clamping elements 21. Upon the removal of the clamping elements 21 the abutting surfaces of the sectors rest snugly on each other also at the places where the partial rings join.

Such a ring, which is made up of sectors 10, may either be slidingly applied to the metal shaft 1 from one end or may be radially mounted on the metal shaft 1 in the way described by joining partial rings.

The decisive criterion is that the rings, which consist of sectors 10, rest directly and with prestress on the sheath area of the metal shaft 1, as can be seen in FIG. 1. This results in the advantages already described, namely a good heat transfer between the protective jacket 5 and the metal shaft 1, less wear and tear upon the metal shaft due to oxidation, and a reduction of detrimental tensions within the protective ring which may result from a differing rates of thermal expansion between the protective ring and the metal shaft or from radial temperature gradients within the protective ring.

FIG. 6 illustrates a further possible type of connection of two springs connected in series 20 which, on the one hand, help to connect the sectors 10 among each other in the way described and which, on the other, are helpful in mounting a ring consisting of sectors 20 with a certain prestress on the metal shaft 1. As shown in FIG. 6, the tips of the springs 20 are equipped with stops 22 for the respective recesses 16 at the ends of the sector bores 15, with the respective spring 20 bracing the respective sectors 10 and at the same time pressing the entire ring, which consists of sectors 10, in assembly position with prestress against the sheath area of the metal shaft 1.

FIGS. 7 and 8 show a further embodiment of the sectors 10. According to this embodiment, the abutting surfaces 13 of the respective sectors 10 which lie in peripheral direction, have at least one surface graduation 17 in radial direction which engages a complementary surface on an adjacent sector in the way illustrated. In this case the metal shaft 1 is always safely protected, even if the abutting surfaces 13 of neighbouring sectors 10 do not snugly rest on each other, thus forming a split between the individual sectors 10 that is covered by the graduations 17. Small splits between the individual sectors may be observed in the assembly position whenever the outside diameter of the metal shaft 1 is greater than specified and/or the inside diameter of the ring, consisting of sectors 10, of the protective jacket 5 is smaller than specified.

FIG. 9 illustrates a possible way in which the rings which consist of sectors 10 can be axially joined, if the protective jacket consists of several rings made up of sectors 10. In this case the faces 14 of the individual sectors 10 have grooves 18 in peripheral direction which are intended for splinc-like joining rings 19. As a result, there is also a tight connection between the faces 14 of the sectors 10 of neighbouring rings.

FIG. 10 shows a further possibility of how the springs 20 may be fastened in the sectors 10. According to this embodiment the faces 14 of the sectors 10 have recesses **15*a* in peripheral direction which accommodate the springs 20 in a similar way as the bores 15 do. The recesses 15*a* may also act as grooves 18 required in the embodiment according to FIG. 9**.

Figure 11:
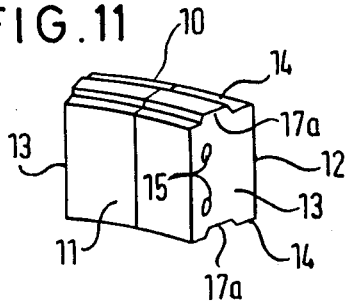

FIG. 11 is an illustration of a sector 10 whose axially directed faces and/or abutting surfaces 14 have a complementary radial graduation **17*a*. This graduation enables neighbouring sectors 10 to be positively joined in axial direction. If the faces and/or abutting surfaces 14 of neighbouring sectors 10 do not snugly fit over the entire area, the resulting split is covered by these graduations 17*a*. As a result, the metal shaft 1 will always be safely protected. Furthermore, by joining the sectors 10 in a positive manner, the protective jacket 5** will be even more resistant from the mechanical point of view.

It is, of course, possible to graduate the peripheral abutting surfaces 13 as well as the axially directed abutting surfaces 14 of each sector in order to brace the entire structure of sectors, which constitutes the protective jacket, not only in a form locking but also in a resilient manner.

Figure 13:
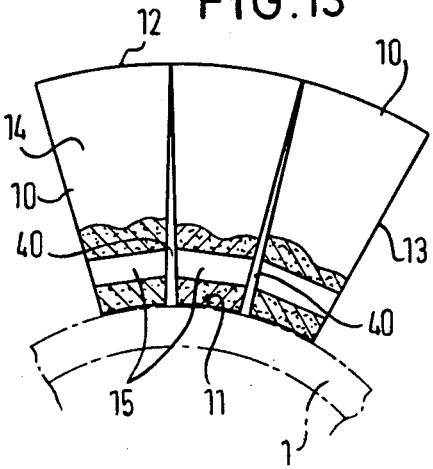
FIGS. 12 and 13 are illustrations of further preferred embodiments of sectors.
Figure 12:
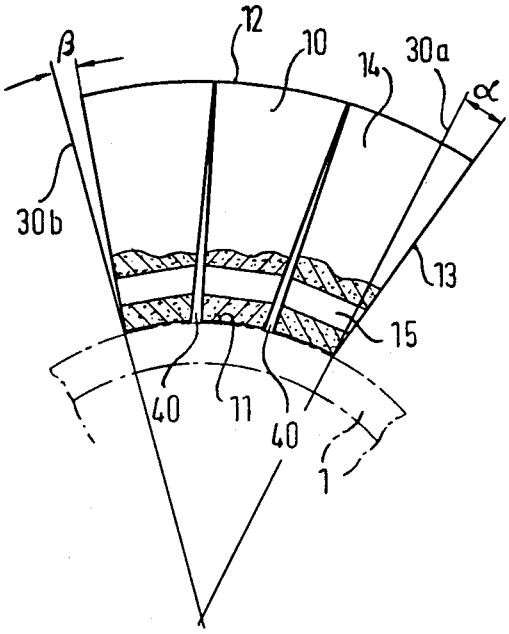

FIG. 12 and FIG. 13 show further embodiments of a protective ring for an electrode in accordance with the invention. According to these embodiments, the width of the individual sectors 10 measured in peripheral direction is relatively small so that a large number of sectors is required for one protective ring. The sides 11 and 12 may be plane. Furthermore, the shape of the sectors 10 may be such that their abutting surfaces 13 and the radial beam **30*a* and/or 30*b* of the hollow cylinder form an angle or two angles and,/or of different sizes. The inner sheath areas 11 of the sectors 10 may be smaller than the outer sheath areas 12** calculated on the basis of a circular division.

As a result, wedge-like splits 40, which become wider towards the interior, will show between the abutting surfaces 13 of the assembled protective ring that rests with prestress on the metal shaft 1. The tangential force component of the spring tension presses the sectors 10, which join in an oblique manner and which have smaller inner sheath areas 11, in such a manner against the metal shaft 1 that the wedge-shaped splits 40 are always closed on the outside. This effect makes it possible to balance tolerances on the outside diameter of the metal shaft 1 and/or on the inside diameter of the ring made up of sectors 10. But even if the sector areas 12 are attacked by oxidation, the wedge-like splits will basically remain closed on the outside.

As is shown in FIG. 12, the bores 15 are not located on the chord of an ideal cylinder sector but they are rather at an angle to this chord. For each sector, therefore, the distance between the sheath area of the metal shaft 1 and one tip of the bore 15 is greater than the distance between the sheath area of the metal shaft 1 and the other tip of the bore, with the respective tips having the same peripheral direction. In this way a tangential force component results from the spring tension which causes the "effect of self-adjustment" described earlier.

Figure 14:
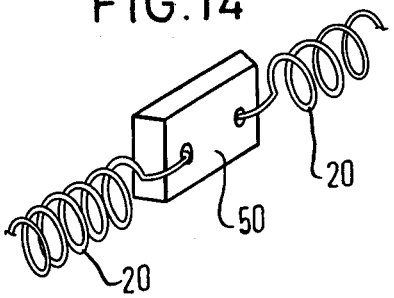
FIG. 14 is an illustration of an alternate preferred means for joining springs to form a spring ring.

In order to prevent the spring which is closed in peripheral direction from being heated by possible parasitic currents, it may be useful to build at least one electrically insulating connection element into the spring. This embodiment is shown in FIG. 14, where the electrically insulating connection element 50 is used for the connection of two springs 20. The electrically insulating connection element 50 for example may be made of highly sintered aluminum oxide.

The same consideration may play a role if electrically insulating elements, e.g. of asbestos (not shown), are inserted between the abutting surfaces of the sectors. Asbestos inserts are recommended especially for abutting surfaces 13 in a peripheral direction, but may, however, also be used for faces and/or abutting surfaces 14 in an axial direction.

Figure 15:
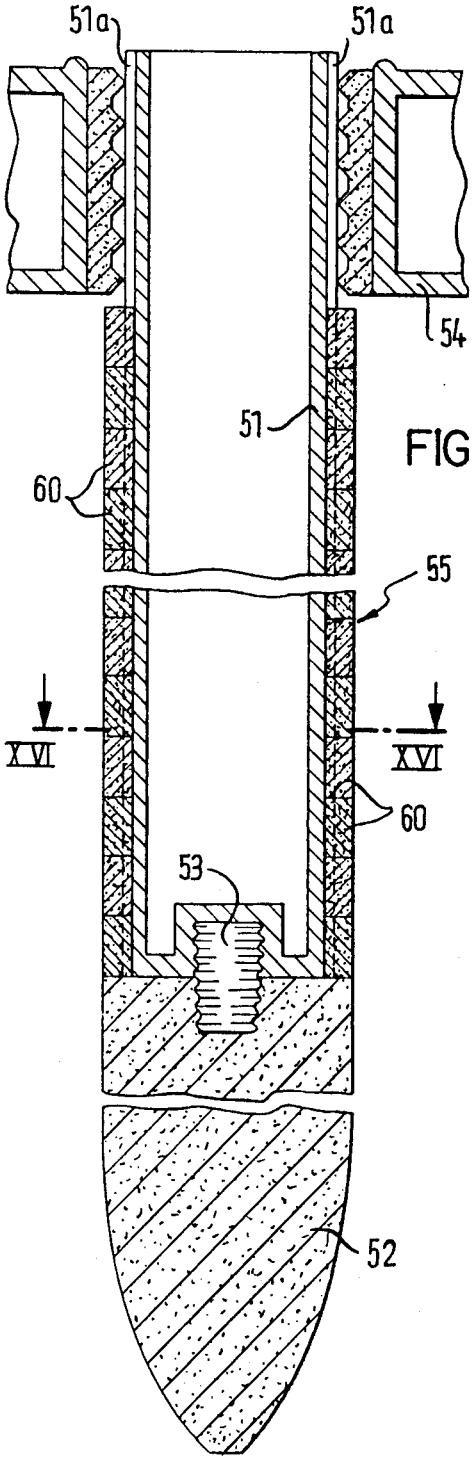
FIG. 15 is an axial sectional view of an electrode and electrode holder in accordance with the invention.

FIG. 15 is a schematic illustration of a basic structure of a combination electrode for electric arc furnaces. This electrode comprises a cooled metal shaft 51 constituting the electrode holder. An active part 52 of consumable material, e.g. graphite, is attached to the lower tip of the metal shaft 51 by means of a threaded nipple 53. The electrode is held by a supporting structure 54 located in the upper section of the metal shaft 51 of the electrode holder. Since FIG. 15 is a schematic illustration only, the electrical components and cooling elements of the electrode holder are not included, as these components may have a conventional design. What is important in connection with the invention is a protective jacket 55 is the form of a hollow cylinder that consists of one of the temperature-resistant materials mentioned. This jacket surrounds the metal shaft 51 of the electrode holder along the section located within the furnace, thus protecting it in the way described against detrimental thermal and mechanical stress.

Figure 19:
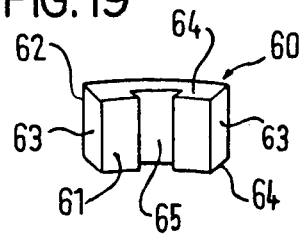
FIG. 19 is a perspective view of a sector.

The protective jacket 55 is made up of hollow cylinder sectors. One of them is shown in the perspective illustration of FIG. 19. The hollow cylinder sector 60 has an inner sheath area 61 and an outer sheath area 62, two abutting surfaces 63 in peripheral direction, and two faces 64 in axial direction. A number of such sectors 60 make up a ring. Several rings consisting of such sectors 60 form the protective jacket 65. The sectors 60 and the sheath area of the cooled metal shaft 51 are joined by means of positive connection elements. In the concrete case these positive connection elements are dovetail guides. Basically, there are two possible designs.

Figure 16:
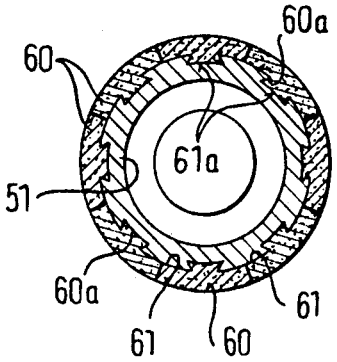
FIG. 16 is a radial sectional view of the electrode of FIG. 15 along the intersection line XVI—XVI.

According to FIGS. 15 and 16 the grooves 65*a* run in axial direction over the sheath area of the metal shaft 51, i.e. they are cut into the sheath area, while the corresponding contact strips 60*a* run over the inner sheath area 61 of the respective sectors 60. If this embodiment is used, the grooves 51*a* run continuously over the entire length of the metal shaft 51, which simplifies the manufacture of the metal shaft 51. However, in this case the sectors can be slid onto the metal shaft 51 only from one end.

Figure 17:
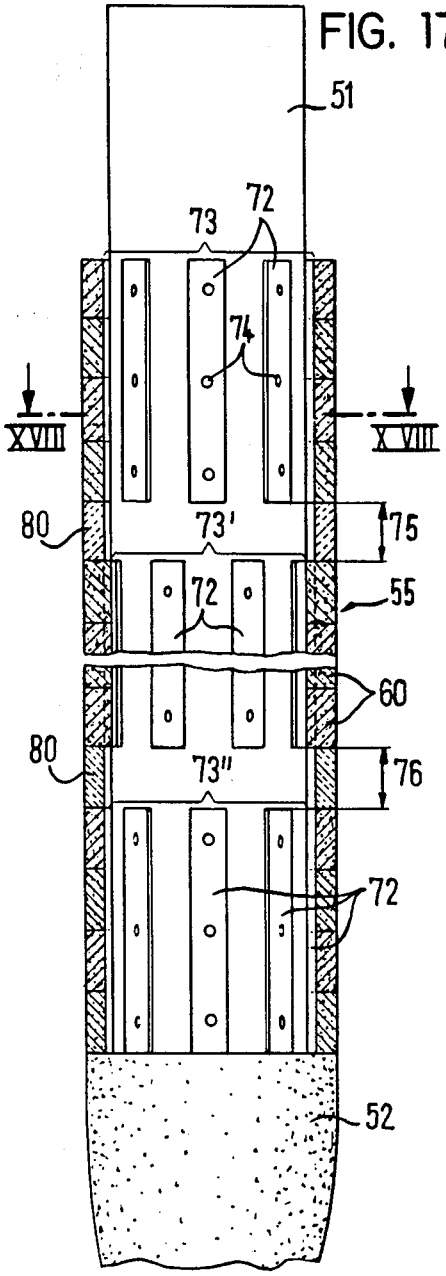
FIG. 17 is an illustration of the metal shaft of the electrode holder in accordance with the invention with the protective jacket partly in cutaway to show the distribution of contact strips on the sheath area of the metal shaft.
Figure 18:
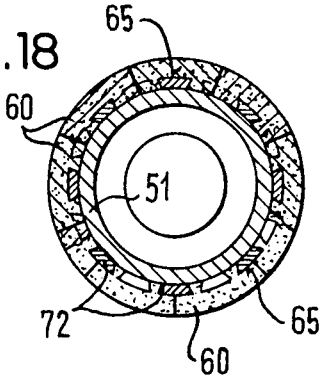
FIG. 18 is a radial sectional view of the electrode as illustrated in FIG. 17 along the intersection line XVIII—XVIII.

If the embodiment according to FIGS. 17 and 18 is used, the contact strips of the dovetail guides are located on the sheath area of the metal shaft 51. They are divided into contact strip sections 72 which are grouped in rings 73 or ring-like longitudinal ring zones taking up at least one ring, preferably, however, two or more ring zones 73 including sectors 60.

The individual contact strip sections 72 are riveted or bolted 74 to the sheath area of the metal shaft 51 and thus removable, if required.

The axial distance 75 between two groups 73 and 73' of contact strip sections 72 is not greater than the twofold axial height of the sectors 60 to be arranged in this region. As a rule, it is recommended to have an axial distance 75 that is somewhat greater than the axial height of the sectors 60 to be arranged in this region. In the area where the contact strips are interrupted it is thus possible to slip the sectors 60 on the individual contact strip sections 72 so that damaged or worn sectors can be exchanged in the middle zone of the protective jacket 55 without having to remove all sectors above and below.

Figure 20:
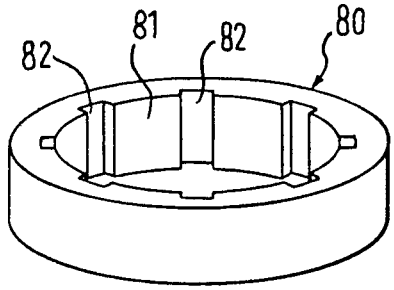
FIG. 20 is a perspective view of a one-piece ring intended for use in a protective jacket of an electrode holder in accordance with the invention.

It has proved useful to place a one-piece ring at certain intervals between the ring-shaped groups. Such a one-piece ring 80 is shown in FIG. 20. The inner sheath area 81 of such a ring 80 has grooves 82 which correspond or are complementary to the contact strip sections 72. Such a ring will, of course, be placed between two groups 73' and 73'' of contact strips 72. For this purpose the axial distance 76 between these two groups 73' and 73'' of contact strip sections 72 is somewhat greater than the axial height of the ring 80. In this way the ring 80 may be moved from one end of the metal shaft 51 to the zone of interruption 76 and turned or rotated radially about the metal sheath in such a way that the grooves 82 and the contact strip sections 72 of group 73'' and, if necessary, also those of group 73' are staggered. In this way the one-piece ring 80 will be firmly secured in axial direction either against the bottom or against both sides. If the sectors arranged below the ring 80 break under certain extreme conditions, the sectors arranged above the ring 80 are safely held by the ring 80. As a consequence, any damage of the protective jacket 55 or of the metal shaft 51 is kept to a minimum.

The group-wise staggering of the contact strips 72, which was described earlier, serves the same purpose, since it prevents the sectors above from slipping down in case of a complete breakdown of the sectors below. An additional advantage of the groupwise staggering of the contact strip sections 72 is that the abutting surfaces 60 of the sectors 63 are also staggered groupwise, which further increases the solidity of the protective jacket 55.

Figure 21:
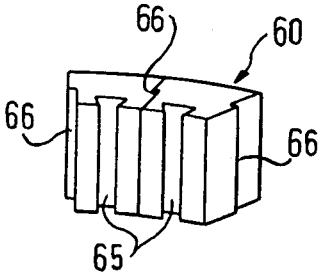
FIG. 21 is a modified embodiment of a sector.

Although the measures described help not only to obtain a snug connection between the inner sheath area 60 of the sectors 61 and the sheath area of the metal shaft but also guarantee that the abutting surfaces of neighbouring sectors rest snugly on each other, the latter may be improved even more. Such an improvement is shown in FIG. 21. The abutting surfaces of two neighbouring sectors 60, which lie in peripheral direction 63, have a complementary radial graduation. As shown in FIG. 15, these complementary graduations 66 of two neighbouring sectors 60 engage. This means that even if there is a split between two neighbouring sectors 60, this split will be covered by the graduations 66. As a result, the metal shaft 51 will nevertheless be safely protected.

Figure 22:
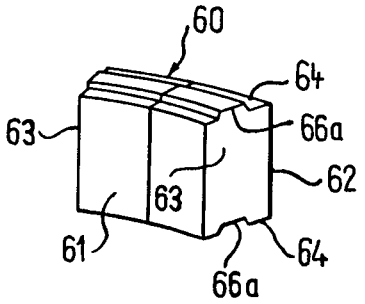
FIG. 22 is a further preferred embodiment of a sector for the protective jacket of an electrode holder in accordance with the invention.

FIG. 22 shows that the axially directed abutting surfaces and/or faces 64 of the sectors 60 of two axially neighbouring rings may have radial complementary graduations that guarantee the safe cover of these areas even if greater tolerances are involved.

Another possibility are ring-shaped coverings between the faces of axially neighbouring sectors which rest on the corresponding peripheral grooves in the sector faces, thus guaranteeing the desired safe cover of possible splits.

Figure 23:
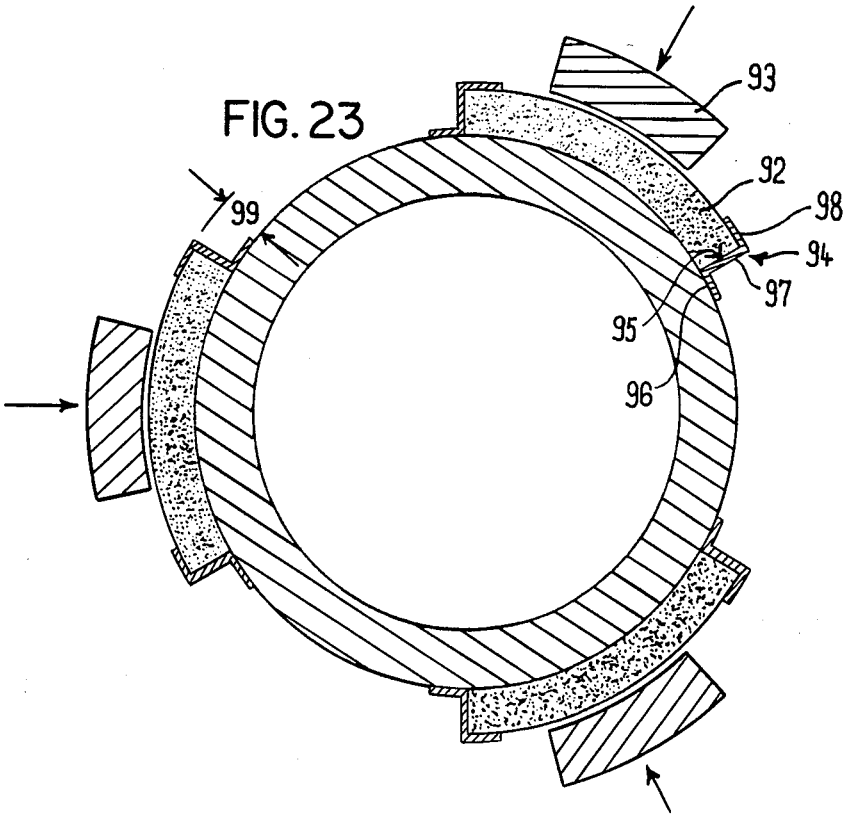
FIG. 23 is an illustration of the metal shaft having three moldings arranged between the metal shaft and electrode clamping jaws, fastened by means of form locking rails.

FIG. 23 illustrates a cross section of the upper part of an electrode holder. On the outside wall of the metal shaft 91 there are three graphite moldings 92 which are held by rails 94. Clamping jaws 93 are pressed against the electrode holder which is thus secured in a certain axial position.

The graphite moldings 92 may be distributed along the periphery in an even or uneven manner, they may have, but need not have, the same size as far as their length on the periphery is concerned, but they should have the same thickness. The rails 94 are affixed to the metal part 91 by suitable bolts. As the graphite moldings occasionally have to be exchanged, bolting is generally preferable to a fixed connection such as welding.

The rails preferably are shaped to encompass the graphite moldings along axial edges in such a manner that these graphite moldings are held against the metal part 91 without tension, for in view of the strong clamping forces of the clamping jaws 93 an excessive prestress would be highly unfavourable.

In order to be able to fulfill this holding function, the rails 94 are designed in such a way that one part 96 rests directly on the metal part 91, one part 97 leads away from the metal part, and one part 98 runs at a certain distance parallel to the metal part. This distance 99 is basically identical with the thickness of the graphite moldings.

We claim:

1. In an electric arc furnace electrode holder having a water-cooled metal shaft and a working part of a consumable material, the metal shaft being at least partly surrounded by moldings of high-temperature resistant material, the improvement comprising the moldings being removably retained surrounding the metal shaft by at least one of form locking and resilient fastening means; said moldings forming a protective jacket, surrounding at least one of portions of the electrode holder located within the arc furnace and a region provided for the clamping of the electrode holder.

2. An electrode holder according to claim 1 said protective jacket (5) comprising at least one ring including several hollowed cylinder sectors resiliently interconnected to rest under a prestress directly upon the metal shaft.

3. An electrode holder according to claim 2 wherein said hollowed cylinder sectors preferably consist of at least one of non-graphitic, partly graphitic materials containing carbon, and ceramic materials.

4. An electrode holder according to claim 3 wherein sectors surrounding upper portions of the metal shaft of the electrode holder consist of ceramic materials, while sectors surrounding lower portions of the metal shaft are made of materials containing carbon.

5. An electrode holder according to claims 2 or 3 the sectors being formed into rings, each ring having at least one spring ring, each spring ring comprising at least one spring, multiple springs being connected in series.

6. An electrode holder as claimed in claim 5 wherein said springs are arranged in sector hollows located essentially concentricly to the ring.

7. An electrode holder according to claim 6 wherein said hollows are located near an inner substantially even surface of said sectors.

8. An electrode holder as claimed in claim 5 wherein said springs consist of a non-magnetic material; having a substantial resistance to elevation temperature.

9. An electrode holder as claimed in any one of claims 1, 2 and 3, the sectors having abutting surfaces, abutting surfaces of neighbouring sectors, having at least one complementary radial graduation.

10. An electrode holder as claimed in claim 1 an outer sheath area of the sectors being even.

11. An electrode holder as claimed in one of claims 2 and 3 wherein the width of the sectors measured in peripheral direction is small relative to a circumference of the sheath.

12. An electrode holder as claimed in one of claims 2 and 3 wherein at least one abutting surface of the sectors and a radial beam of the hollow cylinder form an angle an inner sheath surface of the sectors being proportionally smaller than the surface theoretically resulting from a circular division of an outer sheath surface.

13. An electrode holder according to claim 11 the sectors having abutting surfaces forming differing angles with a radial beam of the hollowed cylinder.

14. An electrode holder according to claim 13 wherein the sectors of a protective ring, due to a tangential force component of spring tensioning are arranged to form wedgeshaped splits open towards the inside and are closed towards the outside between the sectors.

15. An electrode holder according to claim 14 wherein said sectors maintain wedgeshaped splits closed on the outside, even where the outside diameter of the mounted protective ring decreases.

16. An electrode holder as claimed in claim 15 wherein at least one electrically insulating connection element is incorporated in the spring closed in peripheral direction.

17. A electrode holder as claimed in claim 9 wherein electrically insulating elements are inserted in between abutting surfaces of the sectors forming a protective ring.

18. An electrode holder according to claim 1 wherein said moldings comprise rings build up from hollowed cylinder sectors and are removably retained upon the sheath area of the metal shaft by means of form locking connection elements.

19. An electrode holder according to claim 18 wherein said form locking connection elements permit sliding displacement of the build up rings along the metal shaft.

20. An electrode holder according to claim 19 wherein said sectors are retained upon the sheath area of the metal shaft by means of dovetail guides; including grooving located on the inner surface areas of the sectors, contact strips being situated on the surface of the metal shaft.

21. An electrode holder according to claim 20 wherein said contact strips are separate elements which are connected to the sheath area of the metal shaft by at least one of riveting, bolting, and welding.

22. An electrode holder as claimed in claim 19 wherein said protective jacket consists of several rings made up of sectors, a one-piece ring being inserted between any two rings consisting of sectors.

23. An electrode holder as claimed in claim 20 wherein said contact strips are interrupted in the axial direction of the metal shaft, with a distance between two aligned contact strip sections being smaller than a twofold axial height ofthe sectors to be arranged between the aligned contact strips.

24. An electrode holder as claimed in claim 22 wherein said contact strips are arranged in ring-shaped groups, whereby the contact strips of one group and the contact strips of the axially neighbouring group are staggered in peripheral direction.

25. An electrode holder as claimed in claim 20 wherein said abutting surfaces of neighbouring sectors, which lie in peripheral and/or axial direction, have at least one complementary radial graduation.

26. An electrode holder as claimed in any one of claims 19–20, 21–24 and 25 wherein said sectors and said one-piece rings consist of at least one of non-graphitic, partly graphitic materials containing carbon and ceramic materials.

27. An electrode holder according to claim 18 wherein said positive connection elements consist of rails encompassing axial edges of the moldings.

28. An electrode holder according to claim 27 wherein said rails retain the moldings against the metal shaft without prestress.

29. An electrode holder according to either of claims 27 or 28 wherein said rails comprise one part adjacent to the metal shaft, a second leading away from the metal shaft, and a third which is parallel to and set off at a distance from the metal shaft.

30. An electrode holder according to claim 29 wherein said distance corresponds to the thickness of the moldings.

* * * * *

UNITED STATES PATENT AND TRADEMARK OFFICE

CERTIFICATE OF CORRECTION

PATENT NO. : 4,462,104

DATED : July 24, 1984

INVENTOR(S) : Zollner et al

It is certified that error appears in the above-identified patent and that said Letters Patent are hereby corrected as shown below:

In claim 8, column 14, line 12, delete the word "elevation" and insert --elevated--.

In claim 12, column 14, line 25, at the end of the word angle insert --;--.

In claim 23, column 15, line 9, delete the word "ofthe" and insert the words --of the--.

Signed and Sealed this

*Eighteenth* Day of *December 1984*

[SEAL]

*Attest:*

GERALD J. MOSSINGHOFF

*Attesting Officer*

*Commissioner of Patents and Trademarks*